US005881929A

United States Patent [19]

Coerver, Jr.

[11] Patent Number: 5,881,929

[45] Date of Patent: Mar. 16, 1999

[54] PLASTIC COATED MOUNTING CUP FOR SPRAY BUTTON SEAL

[75] Inventor: Robert Albert Coerver, Jr., Bedford, N.H.

[73] Assignee: Summit Packaging Systems, Inc., Manchester, N.H.

[21] Appl. No.: 845,276

[22] Filed: Apr. 25, 1997

[51] Int. Cl.[6] ..... B65D 83/00; B67D 5/42; B65B 1/04

[52] U.S. Cl. ..... 222/402.1; 222/394; 222/402.16; 141/20

[58] Field of Search ..... 222/402.1, 394, 222/402.16; 141/20

[56] References Cited

U.S. PATENT DOCUMENTS

| | | | |
|---|---|---|---|
| 2,731,298 | 1/1956 | Green . | |
| 2,933,222 | 4/1960 | Waldherr . | |
| 3,158,298 | 11/1964 | Briechle . | |
| 3,319,669 | 5/1967 | Abplanalp . | |
| 3,375,957 | 4/1968 | Kuffer . | |
| 3,713,464 | 1/1973 | Nigro . | |
| 3,838,799 | 10/1974 | Meurfsch et al. . | |
| 3,845,887 | 11/1974 | Meuresch et al. . | |
| 4,463,784 | 8/1984 | Butcher et al. . | |
| 4,503,999 | 3/1985 | MacNair et al. . | |
| 4,915,266 | 4/1990 | Nickerbocker . | |
| 4,958,757 | 9/1990 | Greenebaume, II | 222/402.1 |

FOREIGN PATENT DOCUMENTS

| | | | |
|---|---|---|---|
| 2246605 | 2/1992 | United Kingdom | 222/402.1 |
| 81/01695 | 6/1981 | WIPO | 222/402.1 |
| 83/02437 | 7/1983 | WIPO | 222/402.1 |
| 84/01356 | 4/1984 | WIPO | 222/402.1 |
| 86/0671 | 11/1986 | WIPO | 222/402.1 |

*Primary Examiner*—Andres Kashnikow
*Assistant Examiner*—Keats Quinalty
*Attorney, Agent, or Firm*—Davis and Bujold

[57] ABSTRACT

A mounting cup having a plastic film or laminate provided on the top outwardly facing surface thereof, at least adjacent the pedestal portion of the mounting cup, for mating with a skirt of a spray button to provide a sufficient seal between those two components during charging of a pressurized container with a propellant. The perimeter dimension of the skirt is preferably sized to be slightly smaller than the perimeter dimension of the pedestal portion of the mounting cup so that the skirt is slightly expanded upon engagement with the mounting cup. Due to this arrangement, the skirt at least partially bites into the plastic laminate, provided on the top surface of the mounting cup, to provide the sufficient seal between those two components.

18 Claims, 6 Drawing Sheets

PLASTIC COATED MOUNTING CUP FOR SPRAY BUTTON SEAL

FIELD OF THE INVENTION

This invention relates to an improved mounting cup for a pressurized aerosol valve. In particular, it relates to mounting cup having a soft plastic film, laminated or secured to an outwardly facing exterior surface thereof, for engaging with a skirt of a spray button, during charging of an aerosol container with a pressurized fluid, to provide an improved seal between the spray button and the top surface of the mounting cup.

BACKGROUND OF THE INVENTION

A pressurized package conventionally consists of a container, usually a metal can, which contains a product to be dispensed and a propellant and further includes a valve for controlling the flow of the product to be dispensed by the propellant. The pressurized container typically has the propellant supplied thereto by one of two methods.

The first method is the under-the-valve-cup method. The under-the-valve-cup method supplies the propellant to the container before the mounting cup is affixed to the container. This method generally has known drawbacks and shortcomings with the major disadvantage of the under-the-valve-cup method being that it typically has a great loss of the propellant in comparison to the second method, i.e. the pressure filling method. In recent years, there has been a significant trend toward the pressure filling method for filling cans or containers. Currently, a majority of the billions of aerosol containers, which are filled yearly, utilize the pressure filling method.

According to the pressure filling method, the propellant is filled through the valve and then a spray button is subsequently installed on the valve. Alternatively, the container can be filled or charged with the spray button already installed on the valve.

The later pressure filling method is historically known as the button-on-filling (BOF) method. The advantage of the BOF method is that the purchaser of the valves is able to eliminate the step of installing the spray button on the valve, during the production operation, as it has already been previously installed by the valve assembly manufacturer.

One major difficulty encountered in pressurizing a container is achieving a sufficient seal between the filling or charging head, the actuator or spray button and the valve/mounting cup. Past designs employed a special sealing configuration located on the skirt of the spray button adjacent the top surface of the mounting cup. The pressure required for efficiently filling a container can reach as high as 60 atmospheres (900 psig). To compensate for such high pressures, the spray button recently has been made of a relatively soft material, such as polyethylene, in order to facilitate achieving a suitable seal between the spray button and the top portion of the mounting cup. The need to achieve an improved seal, during pressurization, is more important now because the pressurizing gas has been changed, in most manufacturing methods, from chlorofluorocarbon (CFC) to hydrocarbons, which are flammable.

One drawback associated with using a softer material to manufacture the spray button is that the softer material has forced a compromise with respect to other functional aspects and considerations of the valve assembly. The softer material requires that a thicker walled, heavier spray actuator be molded at slower production rates and at higher production costs. The use of the softer material also increases the cost of the spray buttons and the costs of the injection mold design and construction as well as maintenance of the injection mold.

Despite various past efforts, directed at providing an adequate seal between the spray button and the mounting cup, it is still frequently necessary, during pressurization of a container, to increase the downward force of the filling or charging head to seal properly the spray button with respect to the mounting cup. The resulting shortcoming is that the increased load may cause the mounting cup to be depressed excessively, thereby resulting in permanent deformation of the mounting cup. The excessive depression of the mounting cup pedestal may, in turn, produce unwanted side effects, e.g. leakage of the valve, etc.

SUMMARY OF THE INVENTION

Wherefore, it is an object of the present invention to overcome the aforementioned shortcomings and drawbacks associated with the prior art mounting cup designs.

A further object of the invention is to provide a soft plastic film which is laminated to the top outwardly facing surface of the valve mounting cup, at least in the pedestal region, so as to allow the skirt of the spray button to seal effectively against the resilient plastic film rather than the typical hard metal surface of the mounting cup, as with the prior art designs.

Another object of the invention is to provide a superior seal between the skirt of the spray button and top outwardly facing surface of the mounting cup to facilitate the manufacture of the spray button from a harder, thinner walled and lighter weight material.

A further object of the invention is to improve the seal between the spray button and the top surface of the mounting cup during the pressure filling method.

Yet another object of the invention is to provide a seal between the spray button and the top surface of the mounting cup so that an increased pressure that may be utilized during the filling operation and thereby minimize the time for filling each pressurized container.

A still further object of the invention is to simplify the spray button geometry so as to reduce the associated costs in the design, the construction and the maintenance of the injection molding equipment for producing the spray button.

Yet another object of the invention is to facilitate successful pressure filling, with the spray button installed on the valve, regardless of variations in the filling or charging machine, the spray button, the valve mounting cup and/or other variables which occur during the pressure filling method.

The present invention relates to an improved mounting cup having an exterior, outwardly facing surface and an interior inwardly facing surface, said mounting cup including a perimeter curl for attaching said mounting cup to a rim of a desired container, and said mounting cup having a centrally located aperture being surrounded by a pedestal portion; wherein said outwardly facing surface of said mounting cup, at least adjacent said pedestal portion, is provided with an outwardly facing film which is deformable upon engagement with a skirt of a spray button, during a charging operation, to provide an adequate seal between said mounting cup and said spray button.

The present invention also relates to a pressurized container comprising a base portion and a side wall termination at a rim, a mounting cup being crimped to said rim to form a pressurizable container, said mounting cup supporting a valve assembly having a valve element normally biased into a closed position to prevent product flow through said valve assembly, said valve assembly having a product inlet and a valve stem supporting a spray button, a product flow path being defined through said valve assembly from said product inlet to a discharge orifice of said spray button, whereby when said valve assembly is sufficiently actuated, said pressurized container dispenses product via said product inlet through said valve assembly and out through said discharge orifice; wherein an outwardly facing surface of said mounting cup, at least adjacent a pedestal portion of said mounting cup, is provided with an outwardly facing film which is at least partially deformable upon engagement with said skirt of said spray button, during a charging operation, to provide an adequate seal between said mounting cup and said spray button.

The present invention finally relates to a method of charging a pressurized container with propellant, said method comprising the steps of: supporting a valve assembly via a mounting cup; installing a spray button with a skirt on said valve assembly; providing an outwardly facing film on said outwardly facing surface of said mounting cup, at least adjacent a pedestal of said mounting cup, for engagement with said skirt of a spray button; securing said mounting cup to a base container, containing a product to be dispensed, via a crimping process to form a pressurizable container; forcing said skirt of said spray button, via a charging head, into contact with said film on said mounting cup to provide a seal therebetween during a charging operation; supplying propellant from said charging head to an interior of said pressurizable container, along at least one flow path, to form said pressurized container; and withdrawing said charging head from said spray button.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
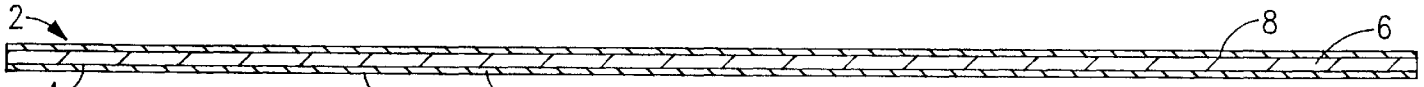
FIG. 1 is a diagrammatic cross-sectional view of the raw material used to manufacture the improved mounting cup according to the present invention.
Figure 2A:
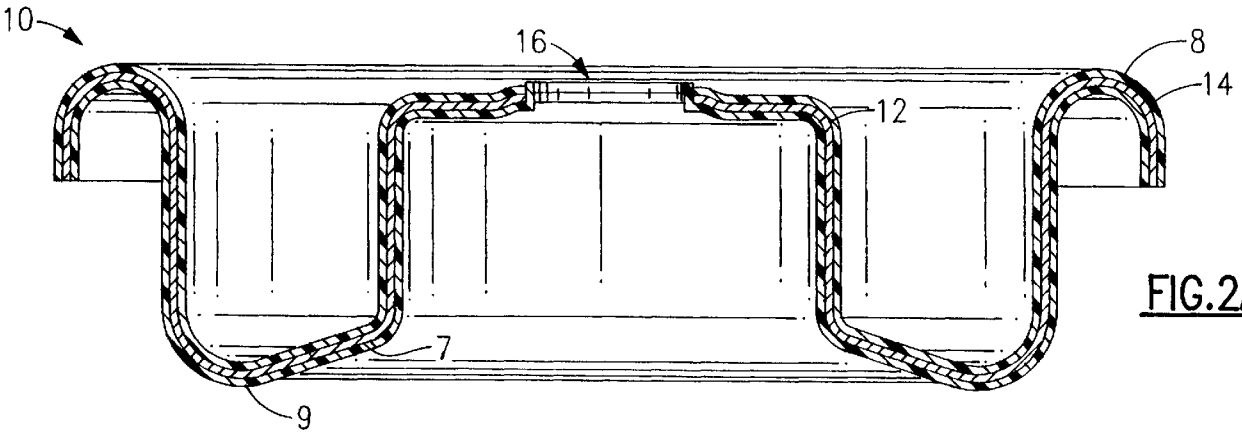
FIG. 2A is a diagrammatic transverse cross-sectional view, along section line 2A—2A of FIG. 2B, of a mounting cup formed according to the present invention.
Figure 2B:
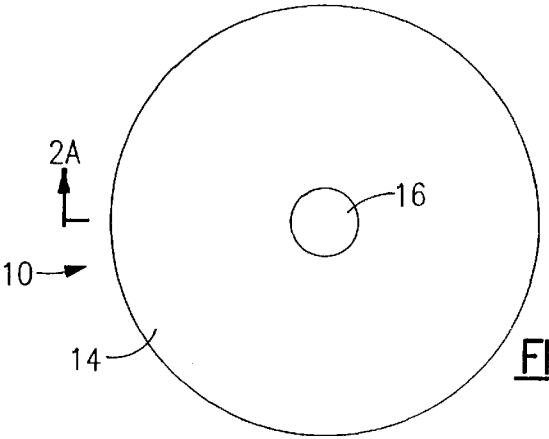
FIG. 2B is a diagrammatic plan view of a mounting cup.

Turning now to FIGS. 1, 2A and 2B, a detailed description concerning the improved mounting cup of the present invention will now be provided. As can be seen in FIG. 1, the mounting cup blank 2 is formed from a base metal 4 such as steel. During the first production step of the mounting cup, a top surface 6 of the mounting cup blank 2 is laminated with an outwardly facing soft plastic film 8, such as polyethylene, high density polyethylene, polypropylene, etc. The plastic film 8 has a thickness ranging from about 0.002 inches to about 0.018 inches (0.05 mm–0.46 mm), more preferably between about 0.004 inches to about 0.012 inches (0.10 mm–0.30 mm), and most preferably between about 0.004 inches to about 0.008 inches (0.10 mm–0.20 mm). Although the plastic film 8 only needs to be located adjacent the perimeter area of the pedestal where the skirt of the spray button will engage with the top outwardly facing surface of the mounting cup, as will be explained hereafter in further detail, it is generally much easier to apply the plastic film 8 to the entire top surface 6 of the base metal 4, during the mounting cup production process.

A bottom surface 7 of the mounting cup 10 may also be laminated with an inwardly facing soft plastic film 9, such as polyethylene, high density polyethylene, polypropylene, etc. The purpose of the plastic film 9 on the bottom inwardly facing surface 7 of the mounting cup 10 is to form a suitable seal between the mounting cup and a base container when the mounting cup 10 is crimped to the container in a conventional manner. As the feature of providing a plastic film 9 on the bottom surface of the mounting cup is well known in the art, a further detailed discussion concerning the same is not provided.

Once the plastic film 8 is applied to at least the top outwardly facing surface 6 of the base metal 4, the mounting cup blank 2 is then stamped, during a conventional stamping process, into a mounting cup 10 similar to the design shown in FIGS. 2A and 2B, which typically has a diameter of approximately 1.25 inches (31.75 mm) or so. It is to be appreciated that the formed mounting cup can have a variety of different shapes and/or configurations and the teaching of the present invention is applicable to all the known designs as well as any new designs of the mounting cup.

Figure 3:
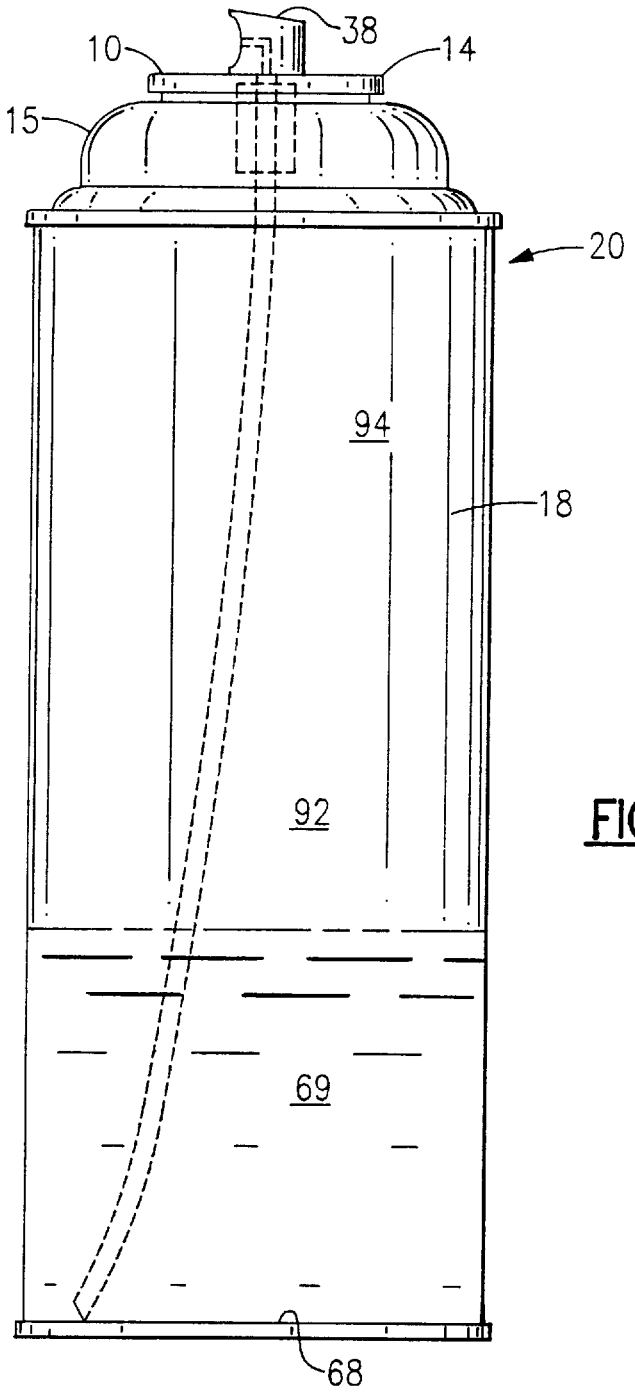
FIG. 3 is a diagrammatic view of a pressurized container containing the improved mounting cup of the present invention with a vertical spray valve.

The formed mounting cup 10 is provided with a pedestal portion 12 as well as a peripheral mounting cup curl 14 for crimping, in a conventional manner, to a perimeter rim of a metal can or some other pressurizable container or to a dome member 15 of a three piece container (FIG. 3). In addition, an aperture 16 is centrally located within the pedestal portion 12 for allowing a stem of a valve assembly to extend therethrough to facilitate actuation of the valve and dispensing of product.

FIG. 3 shows the improved mounting cup 10, according to the present invention, installed on a base container 18 to form a pressurizable container 20. As can be seen in this Figure, an actuator assembly 22 with a vertical valve was crimped to the pedestal portion of the mounting cup 10 and the peripheral mounting cup curl 14 is crimping to the rim to form the pressurizable container 20.

Figure 4:
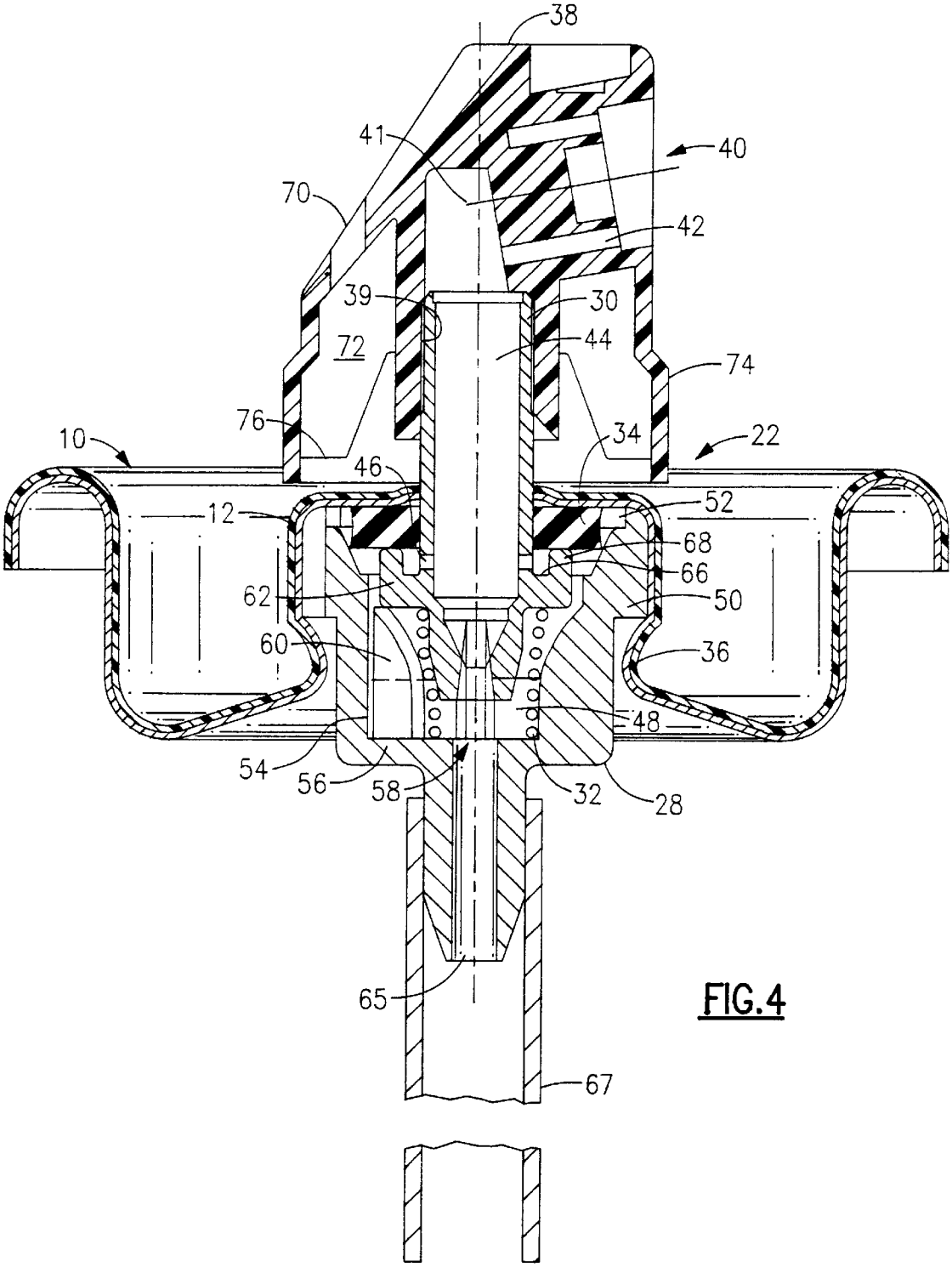
FIG. 4 is a diagrammatic cross-sectional view showing a tilt valve assembly installed on the improved mounting cup according to the present invention.
Figure 5:
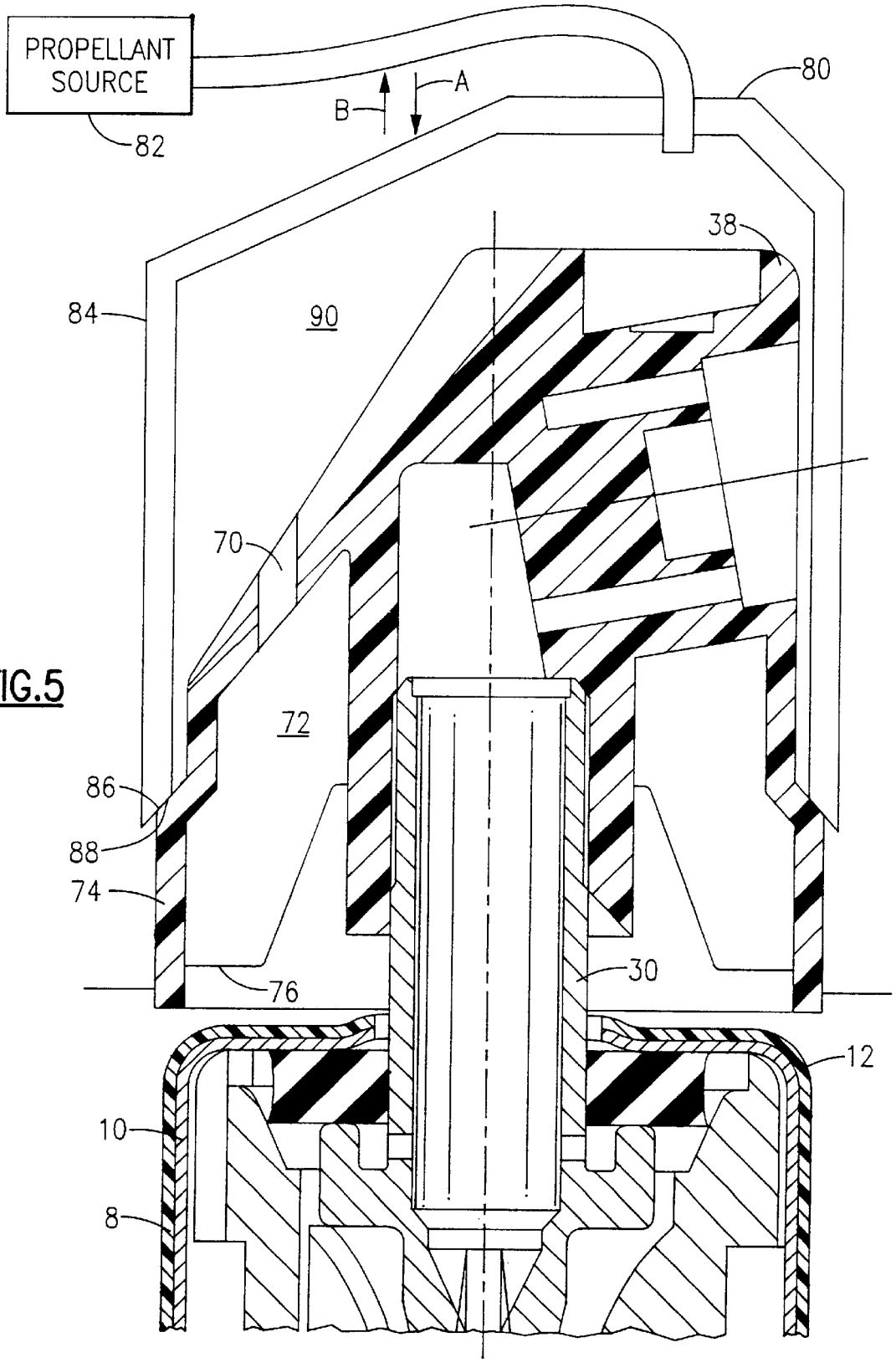
FIG. 5 is a partial diagrammatic cross-sectional view, of the tilt valve assembly of FIG. 4, showing the initial engaged position between the charging head and the spray button of the actuator assembly.
Figure 6:
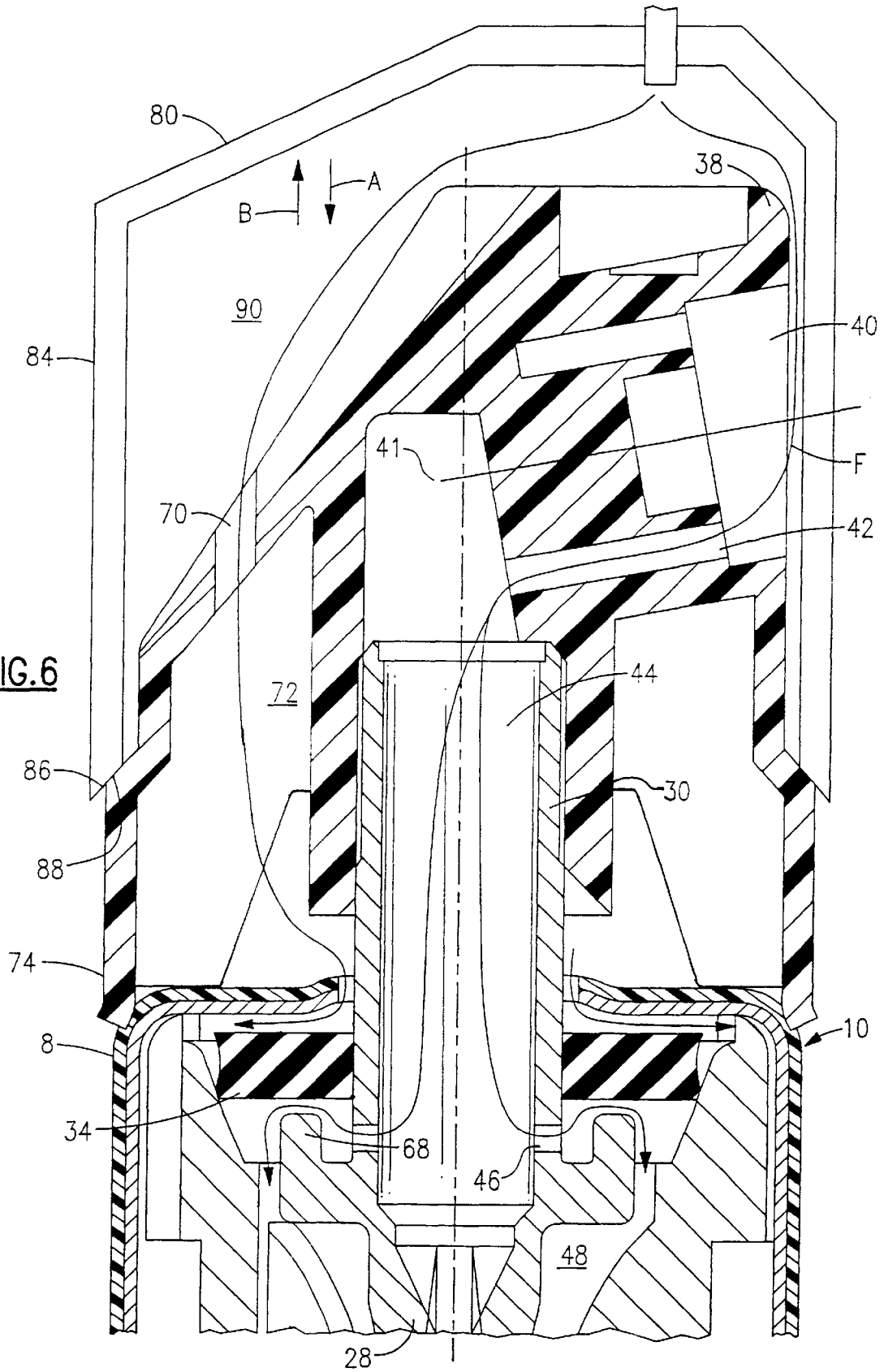
FIG. 6 is a partial diagrammatic cross-sectional view, of the tilt valve assembly of FIG. 4, showing the fully depressed position of the charging head for filling the pressurized container with the propellant.

Turning now to FIGS. 4–6, a detailed description concerning a mounting cup 10, installed on the base container 18, will now be provided. As can be seen in FIG. 4, the mounting cup 10 supports an actuator assembly 22. The actuator assembly 22 comprises a valve body 28 supporting an upstanding valve stem 30, a biasing spring 32, and a gasket 34. The biasing spring 32 and gasket 34 are assembled within the valve body 28 and the valve body 28 is clamped to the mounting cup 10 by means of a plurality of indentations or crimps 36, e.g. four indentations or crimps formed inwardly from the exterior of the side wall of the pedestal portion 12. The crimping operation forces the valve body 28 upward to bias and compressively seal the gasket 34 against the inwardly facing surface of the mounting cup 10. The valve stem 30 protrudes through the central aperture 16 provided in the pedestal portion 12 of the mounting cup 10. A spray button 38, with a central aperture 39, is frictionally fitted over the exterior surface of the upstanding valve stem 30.

The valve stem 30 includes a central bore 44 having one end which communicates with a discharge orifice 40 of the spray button 38 via a button cavity 41 and at least one supply passage 42. The opposite end of the central bore 44 communicates with at least one transverse passage 46, and possibly two (as shown in the figures) or three equally spaced transverse passages, which are temporarily blocked by the gasket 34, when the valve is in its biased normally closed position, as can be seen in FIG. 4. When the valve is sufficiently depressed, communication is established between the transverse passage 46 and an interior valve cavity 48 of the valve body 28 for discharging the product contents from the container 20 and for supplying propellant to the container 20 during the charging operation.

The valve body 28 has a thickened mouth 50 which is provided with a plurality of castellations 52 therearound. The valve body 28 also includes a side wall 54 and a floor 56 which is provided with a central aperture 58. A plurality of locator ribs 60 are molded inside the valve body 28 between the floor 56 and the side wall 54. These locator ribs 60 serve to strengthen the floor and also center the lower portion of the spring 32. During the crimping operation of the pedestal 12, the plurality of indentations or crimps 36 engage a lower portion of the thickened mouth 50 to force the valve body 28 upwardly so as to compress the gasket 34 against the inwardly facing surface of the mounting cup.

The valve stem 30 includes an enlarged head 62 which is formed at the lower end of the valve element and centrally connected to the valve stem 30. An annular recess may be provided on the underside of the head 62, to receive a top portion of the spring 32, and the upper surface 66 of the head is provided with an annular sealing rib 68 which seats against the lower surface of the gasket 34. The transverse passages 46 are located adjacent the head 62 and are normally closed off by the annular sealing rib 68 abutting against the gasket 34 when the valve element is in its bias normally closed position, as can be seen in FIG. 4.

The spring 32 is compressibly disposed between the floor 56 and the enlarged head 62 to urge the valve element away from the floor 56. For dispensing purposes, the described valve operates in a conventional fashion.

A product dip tube 67 is fitted to the lower end of the valve body 28 and surrounds a product inlet 65. A lower end of the product dip tube 67 communicates with the base 68 of the pressurized container (FIG. 3) to facilitate discharging the product contents 69. Upon depression of the spray button 38, the valve stem 30 compresses the spring 32 which allows the product contents 69 to flow up through the dip tube 67 into the valve cavity 48. The product contents 69 then flow between an inwardly facing surface of the valve body 28 and the enlarged head 62 of the valve stem 30. The contents then flow radially, between the gasket 34 and the annular sealing rib 68, through transverse passages 46 into central bore 44 and are discharged from the top of the valve stem 30 through discharge orifice 40 via button cavity 41 and passage 42.

For filling the container with propellant, a product charging path is established through a longitudinal passage 70, provided in the spray button 38 at a location remote from the discharge orifice 40, which communicates with a button interior chamber 72 defined by spray button 38. The interior chamber 72 of the spray button is provided with at least one and preferably a plurality of stop members 76, e.g. three equally spaced stop members, which have a bottom edge spaced a suitable distance from the bottom of a skirt 74. During depression of the spray button 38, the stop members 76 are located to engage with a top surface of the mounting cup 10 thereby to prevent damage to the valve assembly 22 from an overstroke of the valve. The longitudinal passage 70 and interior chamber 72 are utilized for filling the pressurized container with a propellant and the method for charging the pressurized container with propellent will now be described in detail with reference to FIGS. 5 and 6. A charging head 80 is connected to a source propellant 82 under relatively high pressure, e.g. 900 psig, and the charging head 80 is located to completely surround and closely encompass the spray button 38 to facilitate charging of the pressurized container. The charging head 80 has a side wall 84 provided with an inwardly facing tapered flange 86. The flange 86 is arranged to engage a mating outwardly facing tapered flange 88 provided on the exterior surface of the spray button 38 and located adjacent the skirt 74. As the charging head 80 is lowered into engagement with the spray button 38, the flange 86 engages with the mating flange 88 of the spray button 38 and forms a suitable seal therewith. Further lowering motion of the charging head, in the direction of arrow A, forces the skirt 74 of the spray button 38 into engagement with the top outwardly facing surface of the mounting cup 10 (FIG. 6).

The charging head 80 is designed to force the skirt 74 of the spray button 38 into contact with the mounting cup 10. As the plastic film 8 is relatively soft, in comparison to the relatively hard plastic material of the skirt 74, the skirt 74 at least partially bits into and/or at least partially deforms the plastic film 8 supported on the exterior outwardly facing surface of the mounting cup 10 (FIG. 6). In addition, the perimeter dimension of the skirt 74 may be slightly expanded, upon engagement with the film 8 carried by the outwardly facing surface of the mounting cup 10. Such deformation of the film 8 and/or expansion of the skirt 74 facilitates a complete and adequate perimeter seal between the skirt 74 and the top outwardly facing surface of the mounting cup 10.

A second seal is also provided between the mating flanges 86, 88 of the charging head 80 and the spray button 38. If desired, a conventional gasket can be carried on the inwardly facing tapered surface 86 of the charging head 80 to facilitate an improved seal between the charging head 80 and the spray button 38. By this arrangement, the charging head 80 is sufficiently sealingly engaged with the container to prevent the inadvertent escape of propellant during the charging operation. Further, the disclosed engagement establishes two charging paths for charging the pressurized container with propellent.

A first charging path extends from a charging head interior 90 through the discharge orifice 40, passage 42, button cavity 41, central bore 44, transverse passages 46 into cavity 48 along flow path F. A second charging path is established through longitudinal passage 70, provided in the spray button 38, to the chamber 72 along flow path S. From there, the propellent flows through the aperture 16 of the mounting cup 10 along an exterior surface of the valve stem 30 and then flows between a top surface of the gasket 34 as it is at least partially spaced from an inwardly facing surface of the mounting cup 10, e.g. a few thousandths of an inch or so, to form a propellent flow path therebetween. The propellant continues to flow radially along the inwardly facing surface of the mounting cup 10, between the mounting cup 10 and the gasket 34, and then axially down along the inwardly facing surface of the mounting cup 10, between the mounting cup 10 and the valve body 28, until the propellent reaches the interior 92 (FIG. 3) of the pressurized container 20.

Upon completion of the charging operation, the charging head 80 is withdrawn, in the direction of arrow B, and the valve is allowed to return to its normal closed position, via spring 32, in which the gasket 34 abuts against the inwardly facing surface of the mounting cup 10 and the annular sealing rib 68 abuts against a lower surface of the gasket 34 to prevent the inadvertent discharge of any of the product contents 69.

It is to be appreciated that the charging head can also be used to pressurize a container with propellent, prior to installation of the spray button 38, by merely providing the charging head 80 with a mechanism located to adequately depress the valve stem 30, during the charging operation, while still allowing the propellant 94 to be supplied through the central bore 44 of the stem.

The skirt 74 of the spray button 38 is sized to have an inner perimeter dimension which is slightly smaller, e.g. about 0.0942 inches (2.393 mm) or so, than an outer perimeter of the pedestal portion, including the plastic film 8, of the mounting cup. The reason for this is so that skirt 74, when forced against the top outwardly facing surface of the mounting cup 10 during the charging operation, resiliently expands slightly and/or bites into the film 8. By this arrangement, a sufficient seal between the skirt 74 and the film 8 supported on the outwardly facing surface of the mounting cup 10 is achieved. Because of this improved seal, the present invention is able to utilized filling pressures on the order of 900 psig or so and fill a pressurized container 20, containing a product to be dispensed 69, with an adequate amount of propellant 94 within approximately two seconds or so.

Figure 7:
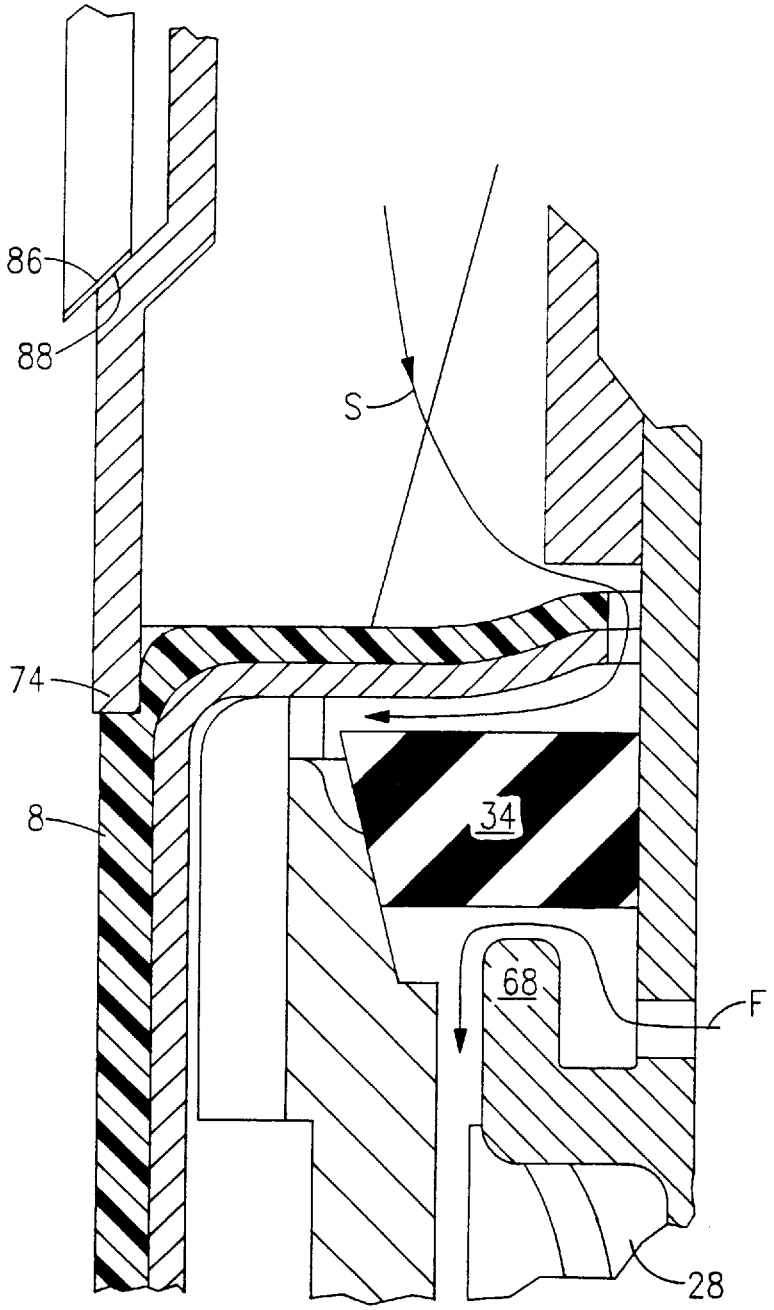
FIG. 7 is a partial diagrammatic cross-sectional view, similar to that shown in FIG. 6, showing the engagement between a spray button made from a harder material biting into a thicker film layer provided on the outwardly facing surface of the mounting cup.

Turning now to FIG. 7, a second variation of the present invention will now be discussed. For some applications, it is desirable to manufacture the spray button 38 from a harder material, e.g. nylon or acetal, so that the inner walls of the spray button can be made thinner. If a harder material is utilized to manufacture the spray button 38, the wall thickness can be reduced by approximately 33%, i.e. from a wall thickness of about 0.030 inches (0.76 mm) to about 0.020 inches (0.51 mm). The skirt 74, when made form a harder, thinner wall material, will tend to resist stretching as it is forced into engagement with the top surface of the mounting cup 10. In order to compensate for less stretching of the skirt 74, the outwardly facing surface 6 of the mounting cup 10 is provided with a thicker layer of the plastic film 8, e.g. the plastic film 8 may approach a thickness of about 0.012 inches (0.30 mm) or so. Accordingly, as the charging head 80 forces the skirt 74 of the spray button 38 into contact with the outwardly facing surface of the mounting cup 10 carrying the film 8, during the charging operation, the skirt 74, according to this embodiment, bites into and deforms the plastic film 8 supported on the exterior surface of the mounting cup 10. As the skirt 74 is manufactured for a relatively harder material then the previous embodiment, the skirt 74 will only expand very slightly, if at all, upon engagement with the film 8 carried by the mounting cup 10, and has a greater biting action into the plastic film 8 thereby still providing a suitable seal between those two components.

It is to be appreciated that while the present invention is disclosed with respect to tilt valves, it is equally applicable to vertical valves, i.e. valves which are vertically depressible along a central axis of the assembly valve. In addition, the particular shape or design of the spray button can vary from application to application. The important features of the spray button are that the spray button be provided with: 1) at least one longitudinal filling passage 70, 2) define a button interior chamber 72, 3) have a circular shaped skirt 74 for engagement with a circular pedestal portion 12 of the mounting cup 10, and 4) contain at least one stop member 76.

Since certain changes may be made in the above described mounting cup, spray button and method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A mounting cup and valve assembly combination for facilitating a charging operation of a product to be dispensed through the valve assembly;

said mounting cup comprising:

an exterior, outwardly facing surface and an interior inwardly facing surface;

a perimeter curl disposed circumferentially around the mounting cup for attaching said mounting cup to a rim of a desired container;

a centrally located pedestal portion having an aperture disposed therein; and a film disposed on said outwardly facing surface of said mounting cup, at least adjacent said pedestal portion;

and said valve assembly comprising:

an upstanding valve stem extending through said aperture of said mounting cup, and said valve stem having a product outlet formed therein;

a product inlet communicating with said product outlet for discharging product through the valve assembly;

a normally closed valve element for controlling the flow of product from said product inlet to said product outlet;

said valve assembly being crimped and permanently retained by said mounting cup with said upstanding valve stem extending through said aperture; and a spray button having a skirt with an inner perimeter which is smaller than an outer perimeter of said pedestal portion of said mounting cup, and said skirt being at least partially expanded, upon engagement with said outwardly facing film of said mounting cup supported by said pedestal portion, during the charging operation, to form a seal therebetween and facilitate charging of a product to be dispensed to a container attached to said mounting cup.

2. The mounting cup and valve assembly combination according to claim 1, wherein said outwardly facing film has a thickness between about 0.002 inches and about 0.018 inches.

3. The mounting cup and valve assembly combination according to claim 1, wherein said film is one of polyethylene, high density polyethylene and polypropylene.

4. The mounting cup and valve assembly combination according to claim 1, wherein said inwardly facing surface of said mounting cup, at least adjacent the perimeter curl, is provided with an inwardly facing film, and said inwardly facing film has a thickness of between about 0.002 inches and about 0.018 inches.

5. The mounting cup and valve assembly combination according to claim 1, wherein said mounting cup is manufactured from a metal and has a diameter of approximately 1.25 inches.

6. The mounting cup and valve assembly combination according to claim 1, wherein said spray button is frictionally fitted over an exterior surface of said upstanding valve stem, and said spray button has a discharge orifice which communicates with said product outlet to facilitate dispensing of the product to be dispensed.

7. The mounting cup and valve assembly combination according to claim 1, wherein a dip tube is connected to said product inlet for conveying the product to be dispensed to said product inlet.

8. The mounting cup and valve assembly combination according to claim 1, wherein a gasket is located between said inwardly facing surface of said mounting cup and said valve assembly to provide a seal therebetween and prevent escape of propellant.

9. The mounting cup and valve assembly combination according to claims 1, wherein said valve assembly is one of a tilt valve and a vertically depressible valve.

10. The mounting cup and valve assembly combination according to claim 1, wherein said spray button is manufactured from a hard material and said outwardly facing film is manufactured from a soft material whereby said hard material of said spray button at least partially bites into said soft material of said outwardly facing film supported by said mounting cup, during the charging operation, to provide an adequate seal therebetween.

11. A pressurized container comprising a base portion and a side wall terminating at a rim, a mounting cup having a centrally located pedestal portion with an aperture disposed therein, the mounting cup having a circumferentially disposed perimeter curl which is crimped to said rim to form a pressurizable container, said mounting cup supporting a valve assembly having a valve element partially extending through said aperture and being normally biased into a closed position to prevent product flow through said valve assembly, said valve assembly having a product inlet and a valve stem supporting a spray button, a product flow path being defined through said valve assembly from said product inlet to a discharge orifice of said spray button whereby, when said valve assembly is sufficiently actuated, said pressurized container dispenses product via said product inlet through said valve assembly and out through said discharge orifice;

wherein an outwardly facing surface of said mounting cup, at least adjacent the pedestal portion of said mounting cup, is provided with an outwardly facing film, and the spray button has a skirt with an inner perimeter which is smaller than an outer perimeter of said pedestal portion of said mounting cup, and said skirt is at least partially expanded, upon engagement with said outwardly facing film of said mounting cup supported by said pedestal portion, and said outwardly facing film is at least partially deformed upon engagement with said skirt, during the charging operation, to form a seal between the skirt and the outwardly facing film and facilitate filling of the container with the product to be dispensed.

12. A pressurized container according to claim 11, wherein said outwardly facing film has a thickness between about 0.002 inches and about 0.018 inches and said film is one of polyethylene, high density polyethylene and polypropylene.

13. A pressurized container according to claim 11, wherein an inwardly facing surface of said mounting cup, at least adjacent the perimeter curl, is provided with an inwardly facing film, and said inwardly facing film has a thickness of between about 0.002 inches and about 0.018 inches.

14. A pressurized container according to claim 13, wherein a gasket is located between said inwardly facing surface of said mounting cup and said valve assembly to provide a seal therebetween and prevent escape of propellant.

15. A pressurized container according to claim 11, wherein said mounting cup is manufactured from a metal and has a diameter of approximately 1.25 inches.

16. A pressurized container according to claim 11, wherein a dip tube is connected to said product inlet for conveying the product to be dispensed to said product inlet.

17. A pressurized container according to claim 11, wherein said valve assembly is one of a tilt valve and a vertically depressible valve.

18. A pressurized container according to claim 11, wherein said spray button is manufactured from a hard material and said outwardly facing film is manufactured from a soft material whereby said hard material of said spray button at least partially bites into said soft material of said outwardly facing film supported by said mounting cup, during the charging operation, to provide an adequate seal therebetween.

* * * * *